United States Patent [19]

Ludlum et al.

[11] Patent Number: 4,652,464

[45] Date of Patent: Mar. 24, 1987

[54] PRINTING FINE ART WITH FLUORESCENT AND NON-FLUORESCENT COLORANTS

[76] Inventors: John P. Ludlum; Shirley G. Ludlum, both of 14741 Devonshire, Tustin, Calif. 92680

[21] Appl. No.: 762,412

[22] Filed: Aug. 5, 1985

Related U.S. Application Data

[63] Continuation-in-part of Ser. No. 410,542, Aug. 23, 1982, abandoned, which is a continuation-in-part of Ser. No. 177,176, Aug. 11, 1980, abandoned.

[51] Int. Cl.[4] ..... B05D 5/06

[52] U.S. Cl. ..... 427/157; 40/442; 427/265

[58] Field of Search ..... 427/157, 260, 265; 40/442, 543; 272/10; 428/199

[56] References Cited

U.S. PATENT DOCUMENTS

| | | | |
|---|---|---|---|
| 490,483 | 1/1893 | Mackaye | 272/10 X |
| 1,462,537 | 7/1923 | de Lipski | 272/10 |
| 2,302,645 | 11/1942 | Switzer et al. | 427/157 X |
| 4,122,237 | 10/1978 | Kaiserman | 427/157 X |

*Primary Examiner*—Evan K. Lawrence

*Attorney, Agent, or Firm*—Plante Strauss & Vanderburgh

[57] ABSTRACT

A method for printing fine or commercial art utilizing visible and/or invisible fluorescent colorants and non-fluorescent colorants in a multiple series of colorant applications with each color application being made with with a predetermined print pattern. As used herein, "fluoresecent colorants" are those which emit visible light under the ultraviolet (black light), including those which are colored and those which are colorless under visible light. The colorants are applied to a base in layers or by blending the fluorescent and non-fluorescent colorants to achieve a predetermined piece of art work. Some of the layers of colorants are used to mask, or partly mask, the brilliance of some of the fluorescent layers, in graduating degrees for viewing under ulrtraviolet observation, or viewing in other lighting conditions. The proportions of the fluorescent and non-fluorescent colorants are also selected to provide a final print which can be displayed under visible and black light conditions and combinations of visible and black light illumination, depicting a subject under day and night illumination with a smooth transition therebetween such as twilight. This colorant application method can also be used to create brillant contrasts in theatrical or other stylized effects.

6 Claims, No Drawings

PRINTING FINE ART WITH FLUORESCENT AND NON-FLUORESCENT COLORANTS

This application is a continuation in part of copending application Ser. No. 410,542 filed Aug. 23, 1982, now abandoned which is a continuation in part of parent application, Ser. No. 177,176, filed Aug. 11, 1980, now abandoned.

BACKGROUND OF THE INVENTION

1. Field of Invention

The invention relates to printing of fine art and, in particular, to a new method of printing fine or commercial art utilizing fluorescent and non-fluorescent colorants.

2. Description of the Prior Art

Fluorescent colorants have been used with visible light colorants for various effects. Daylight fluorescent colorants have been mixed with visible light colorants to brighten their color. The invisible or black light fluorescent colorants have also been used theatrically for special effects, utilizing their dramatic fluorescent properties under black light or ultraviolet illumination.

The present applicants have used visible and invisible fluorescent colorants in combination with daylight colorants to paint fine art capable of simulating day and night views of a subject when displayed under visible and black light illumination. Because of the vast variation in response of fluorescent colorants to visible and ultraviolet illumination, only a few other artists have attempted painting with fluorescent and visible light colorants with questionable results. The art community has largely avoided such painting because of the great difficulties in achieving natural or aesthetically satisfying results. Printing with fluorescent and non-fluorescent colorants has never been successfully employed with fine art heretofore since the limitations of the printing techniques further compound the difficulties of using fluorescent and non-fluorescent colorants.

SUMMARY OF THE INVENTION

This invention comprises a method for printing art utilizing multiple applications of colorants with each colorant preselected and applied in a predetermined print pattern to obtain a fine or commercial art product. The method utilizes, in the printing process, visible and/or invisible fluorescent colorants which are applied to preselected areas of the art work in a predetermined pattern to achieve the desired colors under visible or daylight viewing and to blend with the non-fluorescent colorants under black light illumination so that the fluorescent colorants are blended or masked under light illumination. The relative proportions and the colors and shades of colors of the non-fluorescent colorants and the visible and invisible fluorescent colorants are preselected to provide a gradual, subtle, transition of the art when viewed under lighting conditions which are varied from visible to black light illumination or to blend or shade the effect or subdue the intensity of the fluorescent colorants in preselected areas to give a more natural, or softer effect under black light illumination. The resultant art work provides a subject which is depicted under day and night illumination with a smooth transition therebetween, such as twilight,, as the lighting conditions are varied from visible to black light illumination, going through varying combinations of visible and black light illumination between these extremes.

DESCRIPTION OF A PREFERRED EMBODIMENT

The method of this invention is broadly applicable to any of the presently known and practiced printing techniques. The method can be used in stencil printing wherein predetermined patterns of color are applied using a spray, brush, roller or squeegee. A specific example of a stencil technique which can be used for fine art printing is silk screen printing wherein a silk screen stretched on a frame is prepared as a stencil in various ways such as a hand painting, film masking or photographically developing a pattern on the silk screen to provide a pattern of predetermined openings in the silk screen through which the color can be applied to the base.

Other printing techniques that can be employed include lithography wherein a plurality of raised or planographic patterns are developed on a series of plates or stones and the series of plates or stones are sequentially used with applications of colors to produce a final product. The plates or stones can be prepared by the artist drawing on the plate or stone, thus preparing a hand-pulled lithograph or the plate or stone can be printed using photographic development of an original work of art. In either technique, the plate or stone is prepared with predetermined areas which accept or reject the color so that the plate or stone can be used to transfer the color in a predetermined pattern to the base.

Other printing techniques which can be employed include block printing wherein a predetermined pattern is carved or etched into a block such as patterns which are carved into blocks of wood, linoleum, paper or metal that can then be used to transfer colors to a base in a series of color applications. Other printing techniques include color type printing or the rotogravure technique wherein rotary or flat bed presses are employed which are surfaced with offset patterns that apply predetermined colorants in the form of dyes or inks to the base.

In all of the aforedescribed techniques, the colors are applied in multiple applications of predetermined patterns of colors. Typically, the artist utilizes at least three applications of the colors to achieve the desired effect. The use of only two color applications does not achieve the quality of color desired in fine art and, accordingly, applications of many, e.g., from 3 to about 25 applications, predetermined colors and blends of colors can be used.

The base which is printed in accordance with the invention can be any surface, synthetic or natural, which is suitable for reception of colorants such as pigmented colors, dyes or inks. Usually, the base will be a paper sheet material, although, canvas, silk, or other woven fabric materials such as wool, hair, straw can be printed with the invention. Other materials are acetate, mylar, tracing paper, metal and leather, and other man made materials.

The printing process is modified to include applications of fluorescent colorants or the fluorescent colorants are modified by the printing or hand process. Usually, this involves increasing the number of printing steps by increasing the number of pattern applications of colorants. As with the application of the non-fluorescent, visible colorants, the use of the fluorescent colorants also requires a multiple step printing process with the application of a plurality of predetermined fluorescent colorants to achieve the desired finished appearance of the art product. The use of the fluorescent colorants in the printing process, however, also presents a secondary effect which must be controlled. When the so-called invisible fluorescent colorants are used, i.e., colorants which fluoresce only under black, ultraviolet light, these fluorescent colorants must be applied to the fine art product in a manner which does not interfere with the visible light colorant patterns. Typically, the invisible fluorescent colorants are neutral to visible light and have a clear, white or buff appearance. These colorants must, therefore, be applied to the fine art product in quantities and in predetermined patterns of application so as to blend with the visible light colorants, thereby masking or modifying their presence under daylight illumination. This is accomplished in the invention by printing the predetermined areas with gradations of both visible light colorants and the invisible fluorescent colorants.

The fluorescent and non-fluorescent colorants are applied in predetermined patterns which although depicting the same subject, are not identical but are, in fact, vastly different since a subject appears differently at night than it does in daylight. A smooth transition between the views is achieved by blending the preselected fluorescent, into the non-fluorescent, colorants to present a smooth transition from day lighted to night lighted views of the subject as the incident light is varied from visible to black light conditions. An example of this is a lantern which appears unlit in the daylight pattern. The fluorescent colorants are applied in a distinct pattern, different than the pattern of non-fluorescent colorants with the greatest density of fluorescent colorants at the lantern light source and decreasing in density outwardly therefrom, such that under fluorescent light, and as the incident visible light diminishes, a dim glow appears in the depth of the lantern. As the visible illumination further diminishes, the lantern glow intensifies and spreads outwardly covering a greater and greater area. The light in the center of the lantern is visible first, then gradually, the light spreads to the entire lantern, then to a glow around the lantern—a halation. As the light area grows in size, we see, at the light source, stronger and stronger light. Also as it spreads, it begins to illuminate objects in its path, but these are never as strong, or as bright as the light source itself as the farthest limits of the light spread are not seen until the room light level is very low.

The aforedescribed effect is achieved by applying the fluorescent colorants in a pattern which is different from the pattern of the non-fluorescent colorants, even though both patterns depict the same subject. These patterns are distinct, particularly in depiction of lights and shadows.

It is often desirable to utilize daylight fluorescent colorants in combination with visible colorants and invisible fluorescent colorants. The daylight fluorescent colorants are colorants which have the property of fluorescence under illumination by the ultraviolet portion of the daylight spectrum as well as fluorescing brilliantly under ultraviolet lights. When these daylight fluorescent colorants are employed, they also are applied in a multiple pattern application technique wherein predetermined patterns to achieve the desired visible light fluorescence without interfering with the color patterns of the visible light colorants as well as the invisible fluorescent colorants. The daylight fluorescent colorants may also be modified, masked or blended with visible light colorants to emphasize their brilliance or to tone down and blend them in preselected areas.

The colorants which are used in the method are inks and/or paints. In inks, the powdered pigment or soluble dye of a colorant is suspended or dissolved in a solvent, typically water or mineral oil distillate and the viscosity and physical property of the resultant liquid are adjusted for printing applications. Since fluorescent inks are fugitive, we prefer to use the fluorescent colorants as paints and, indeed, that is necessary to obtain a permanent print using fluorescent colorants which are presently available. In paints, insoluble pigments are suspended in liquid carriers such as water or a mineral oil distillate together with film forming additives such as drying oils or a latex and the resultant liquid suspension has its physical properties such as viscosity adjusted for printing.

The visible light colorants typically use pigments such as inorganic salts and metal oxides. The fluorescent colorants are used in a pigment form, however, these are typically finely subdivided solid solutions of fluorescent salts and/or dyes in transparent resins. Typical resins which are used for preparation of the solid solutions include melamine-formaldehyde or triazine-formaldehyde resins which have a brittle glass-like property and which can be finely ground to a powder of proper size, typically with average particle diameters of 2 to about 10 microns.

Inks, rather than pigmented colors must be used in printing since the pigments are too coarse for a printing press and will block the recesses of fractional-tone printing surfaces. Also the liquid carriers used with pigments have characteristics adverse to the use of a printing press, such as improper drying rate, viscosity and tack. Accordingly, the pigmented fluorescent colorants are by methods other than a printing press, e.g., by silk screen, sponge, brush, wood block, linoleum block, etc.

The non-fluorescent visible colorants are typically formed of inorganic oxides and salts of metals. Examples of these pigments are set forth in the following table:

TABLE I

Colorant pigments - non-fluorescent

| Name | Pigment |
|---|---|
| Cadmium yellow | Cadmium and zinc sulfides |
| Cadmium orange | Cadmium selenite |
| Cadmium red | Cadmium sulfide and selenite |
| Red iron oxide | Ferric oxide |
| Brown iron oxide | Ferric oxide |
| Yellow iron oxide | Ferric oxide Molybdenate |
| Chromium green | Chromium oxide |
| Cobalt blue | Cobalt oxide and alumina |
| Chrome yellow | Lead chromate |
| Chrome orange | Lead chromate and lead oxide |
| Zinc yellow | Zinc chromate |
| Ultramarine blue | Aluminosilicate sulfur complex |
| Carbon black | Carbon |

Non-fluorescent colorants can also include organic pigments such as phthalocyanine pigments which have color hues from blue to green, such as copper phthalocyanine which is blue; vat pigments such as anthraquinones, perinones and thioindigos; azo pigments; diaxazine; and isoindolinone.

Many of the aforementioned organic pigments are available as dyes, soluble in water or organic solvents and can be used in this manner similar to an ink in the printing process to provide transparent colors.

The colorants which are used can also include opacifiers to reduce their transparency. Various solids have been suspended in colorants to serve as opacifiers, typical materials include calcium carbonate, zinc oxide, lead white, antimony oxide, zinc sulfide, and titanium dioxide.

The visible fluorescent pigments, as with the invisible fluorescent pigments, are in reality fluorescent salts and/or dyes which are dispersed in a glass-like, brittle plastic which is ground into a fine degree of sub-division, typically from 1 to about 10 microns particle diameter. The dyes which are employed for the visible fluorescent colorants are rhodamine or a 4-aminonaphtyalimide. With these dyes, phthalocanide pigments can be combined to obtain blue and green fluorescent colorants. The aforementioned dyes or salts are dispersed in the brittle, glass-like resin, such as melamine formaldehyde or triazine formaldehyde resins. The resultant pigments are transparent, however, they can be combined with opacifiers such as titanium dioxide or can be used directly as a transparent visible light fluorescent colorant.

The invisible fluorescent colorants are formed with pigments which are typically clear, white, or buff appearing in visible light but which fluoresce in vivid colors under ultraviolet, black light.

The aforedescribed pigments are commonly dispersed in a suitable liquid carrier for preparing an ink or paint which can be applied in the printing process. Various liquids can be used for this purpose, including aqueous emulsions of latex compounds, e.g., emulsions of common film forming polymers such as polyvinyl acetate, acrylonitrile-butadiene-styrene, copolymers, etc. Mineral distillates can also be used as a suitable liquid carrier for the pigments, using polymerization film forming additives such as drying oils, varnishes and the like.

The art work can be further finished by detailing with hand application of fluorescent or other pigments, at any time, before, during, or after the printing steps. To illustrate, fluorescent pigments can be flocked onto the work with a suitable adhesive, e.g., varnish. Additionally, the work can have hand detailing of colorants applied by any of the following techniques: block printing, stenciling, air brush, air gun, spatter, roller, pounce, sponge, flocking, pen and ink, brush, palate knife, etc.

The invention will be exemplified and the results achieved thereby demonstrated by the following examples:

EXAMPLE I

A landscape is to be printed which, under daylight viewing, appears with a light blue sky with white clouds shading to gray at the edges and a green landscape of hills and trees beneath. Under ultraviolet light, the landscape is to appear with a midnight blue sky having sections of green and yellow at the horizon, illustrating a sunset. A violet-gray cloud is to appear in the sky edged with gold (yellow to orange) tones. The landscape scene appears in brown tones under a cool appearing illumination, simulating a moonlight scene.

In this particular example, the prints are prepared with a serigraph method using silk screens which are prepared by photographic masking. In this technique, photographs are taken of the original art work utilizing primary color filters to obtain black and white images for each of the primary colors and for black and these are used to photographically prepare the silk screen stencils for each of the primary colors and for black. The silk screen stencils which are used provide an irregular pattern of screen apertures in the unmasked areas at densities of approximately 85 lines per inch.

The printing is applied to a precoated paper stock such as a high-quality clay coated paper. In the first application, the blue printer silk screen stencil is used and a light blue pigment of solid color is applied to the paper. With another silk screen stencil, a second application is made using substantially the same blue colorant as in the preceding step to which a small amount of a black light blue fluorescent colorant is added. Using another silk screen stencil, a third application is made, using the light blue color which has blended with it a small amount of black light fluorescent pigments. With yet another silk screen stencil, the light blue, fluorescent pigmented color is blended with a small amount of black light fluorescent yellow pigment and the resulting mixture is screened onto the print. The resultant sky will appear light blue in daylight, but will look very dark blue under ultraviolet illumination as the blue artists (non-fluorescent) color absorbs light. All artists colors appear darker under ultra-violet light when there is a low light level of other light. Some of the colors will, in fact, appear very dark, midnight blue, or even black under these conditions. With the final addition of a fine veil of black or other dark color by the printing press (in the last step of the method described in this example), a light blue sky would be only slightly muted under daylight illumination, but the version under ultraviolet illumination would be that of an evening sky.

A cloud pattern is then applied using a silk screen stencil, e.g., a hand modified printer silk screen stencil, to apply a white pigmented colorant. The clouds can be shaded at their edges by the final addition of a graduated veil of half tone dots from the printing press process, in the last step of this example. Using another screen, a colorant to which has been added a slight amount of yellow and orange visible light pigments and yellow and orange black light fluorescent pigments is applied. These colorants are applied along the bottom portion of the cloud pattern. If desired, further applications of the yellow and orange visible and black light fluorescent pigments can be applied using the red printer silk screen stencil. The white clouds under daylight illumination will appear violet-gray under ultraviolet illumination. The edges of the clouds, which appear gray under daylight illumination will become gold under ultra-violet illumination.

The print is finished using a printing press with printing inks. The printing press employs offset patterns which are also photographically prepared using screens for the primary color and black negatives. The offset patterns are used to apply a pale green printing ink to obtain a soft green coloration to predetermined areas of the landscape. A second application of a deeper green is then applied to predetermined areas using a second offset pattern. Finally, the entire scene is printed in a multi-valued black tone ranging from a very thin veil to sharp lines on the print, to provide the desired shading of the colors and to mute the fluorescent colors, shading their brilliance to create a realistic effect.

The preceding example illustrates the use of the printing technique utilizing half tone or grained screens to partially mask the brilliance of the fluorescent colorants and obtain a subdued and aesthetically pleasing print.

The example also illustrates the preferred application of the fluorexent colorants with a silk screen since the pigments of these colorants are best suited for this application and have a lower adaptability to inks and greases commonly used in offset printing techniques. The example also illustrates the preferred technique of applying the fluorescent patterns in the early stages of preparation of the print, followed by the printing of half tone patterns over the fluorescent colorants. In some cases, however, the silk screen stencil method can be used before, between, or after the printing on the press (lithograph) to obtain varied effects.

The invention has been described with reference to the illustrated and presently prefered embodiment. It is not intended that this disclosure of the presently preferred embodiment be unduly restricting. Instead, it is intended that the invention be defined by the means, and their obvious equivalents, set forth in the following claims:

What is claimed is:

1. The method of preparing, by a printing process, fine art having the characteristic of depicting a subject under markedly different light conditions with a smooth transition therebetween when observed under illumination varied from daylight or incandescent visible to ultraviolet black light which comprises applying to a base a multiple series of color applications with a plurality of silk screens, each application made using a predetermined pattern, and utilizing in said series of color applications, black light or visible light fluorescent colorants in a solid form as a pigment or dispersed in finely divided solid plastic particles, by applying in multiple applications to preselected areas of said base the aforesaid colorants in preselected colors and proportions, and using at least one black light pattern to simulate a night, illuminated view of said subject matter and printing thereover non-fluorescent colorant inks in preselected colors, and proportions, and in a visible light pattern distinct from said black light pattern to simulate a day illuminated view of said subject matter, and said fluorescent and non-fluorescent colorants used in proportions to blend said fluorescent colorants into the non-fluorescent colorant visible light pattern, thereby masking the presence of said fluorescent colorants under visible light observation and providing a final product that simulates a day illuminated view of the subject matter under visible light and a night illuminated view of the subject matter under black light with a smooth transition therebetween as the illumination is varied from visible to black light illumination using various proportions of visible and black light.

2. The method of claim 1 wherein said applications of said non-fluorescent colorants are made with predetermined patterns using stencil, printing or lithographic techniques.

3. The method of claim 1 wherein said art work is printed with a half tone pattern of non-fluorescent inks over said fluorescent colorants at a sufficient pattern density to mute the brilliancy of the fluorescent colorants.

4. The method of claim 2 wherein said fluorescent colorants are pigmented colorants and are applied with silk screen stencils.

5. The method of claim 2 including the steps of hand detailing said fine art by the application of a colorant without the use of a printing aid.

6. The method of claim 3 wherein preselected fluorescent colorants are applied in different proportions and to different areas than said non-fluorescent colorants.

* * * * *